US006920293B2

(12) United States Patent
Izawa et al.

(10) Patent No.: US 6,920,293 B2
(45) Date of Patent: Jul. 19, 2005

(54) IMAGE FORMING APPARATUS AND HEAT FIXING APPARATUS

(75) Inventors: Satoru Izawa, Shizuoka (JP); Akihito Kanamori, Shizuoka (JP); Shinji Hashiguchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/698,416

(22) Filed: Nov. 3, 2003

(65) Prior Publication Data

US 2004/0091279 A1 May 13, 2004

(30) Foreign Application Priority Data

Nov. 6, 2002 (JP) ..... 2002-322135

(51) Int. Cl.[7] ..... G03G 15/20
(52) U.S. Cl. ..... 399/67
(58) Field of Search ..... 399/67, 320

(56) References Cited

U.S. PATENT DOCUMENTS

| | | | | |
|---|---|---|---|---|
| 5,149,941 A | | 9/1992 | Hirabayashi et al. | 219/216 |
| 5,210,579 A | | 5/1993 | Setoriyama et al. | 355/285 |
| 5,450,181 A | | 9/1995 | Tsukida et al. | 355/282 |
| 5,525,775 A | | 6/1996 | Setoriyama et al. | 219/216 |
| 5,697,037 A | * | 12/1997 | Yano et al. | 399/333 |
| 5,722,026 A | | 2/1998 | Goto et al. | 399/333 |
| 5,860,051 A | | 1/1999 | Goto et al. | 399/529 |
| 5,862,435 A | | 1/1999 | Suzumi et al. | 399/68 |
| 5,920,757 A | | 7/1999 | Izawa et al. | 399/329 |
| 5,960,233 A | | 9/1999 | Goto et al. | 399/69 |
| 6,298,213 B1 | | 10/2001 | Miyamoto et al. | 399/320 |
| 6,493,521 B2 | | 12/2002 | Miyamoto et al. | 399/44 |
| 6,519,426 B2 | | 2/2003 | Goto et al. | 399/69 |
| 2001/0016132 A1 | | 8/2001 | Nanataki et al. | 399/330 |
| 2002/0118977 A1 | | 8/2002 | Hasegawa et al. | 399/69 |
| 2002/0168202 A1 | | 11/2002 | Izawa et al. | 399/329 |
| 2003/0029853 A1 | | 2/2003 | Izawa et al. | 219/216 |
| 2003/0035667 A1 | | 2/2003 | Izawa et al. | 399/333 |
| 2003/0038125 A1 | | 2/2003 | Kataoka et al. | 219/216 |
| 2003/0042241 A1 | | 3/2003 | Uekawa et al. | 219/216 |
| 2003/0118363 A1 | | 6/2003 | Izawa et al. | 399/69 |

FOREIGN PATENT DOCUMENTS

| | | | |
|---|---|---|---|
| JP | 63-313182 | 12/1988 | |
| JP | 02-157878 | 6/1990 | |
| JP | 4-44075 | 2/1992 | |
| JP | 4-204980 | 7/1992 | |
| JP | 2001075417 A | 3/2001 | G03G/15/20 |
| JP | 2002108125 A | 4/2002 | G03G/15/20 |

* cited by examiner

*Primary Examiner*—Quana Grainger
(74) *Attorney, Agent, or Firm*—Fitzpatrick, Cella, Harper & Scinto

(57) ABSTRACT

A heat fixing apparatus for fixing an unfixed image formed on a recording material is provided with a discharge roller coming into contact with a recording material and positioned at a downstream side of a fixing nip in a conveying direction of the recording material, and, for improving a fixed image tailing phenomenon, applies a bias voltage to at least either of a fixing film and the discharge roller. In case the recording materials are fed in continuous manner, a bias voltage while the recording material is passed through the fixing nip is elevated or lowered according to a number of heating of the recording materials. In this manner it is possible to reduce deposition of toner, paper powder, dust etc. to the surface of the fixing member, generated particularly in case of a continuous supply of the recording materials under a high bias voltage, thereby preventing generation of an image defect such as blobs resulting from a toner contamination.

20 Claims, 11 Drawing Sheets

FIG. 7A

| NUMBER OF SHEETS | 1-20 | 21-23 | 24 | 25-27 |
|---|---|---|---|---|
| EXPERIMENT 1 | −1000V | −1000V | −1000V | −1000V |
| EXPERIMENT 2 | −1000V | −500V | −1000V | −500V |
| EXPERIMENT 3 | −1000V | −300V | −1000V | −300V |
| EXPERIMENT 4 | −1000V | −100V | −1000V | −100V |

FIG. 7B

| | COMPARISON RESULT OF FIXING SMEARED TRAILING EDGE | | | | COMPARISON RESULT OF TONER CONTAMINATION |
|---|---|---|---|---|---|
| NUMBER OF SHEETS | 1ST SHEET | 21ST SHEET | 24TH SHEET | 25TH SHEET | |
| EXPERIMENT 1 | 3 | 4 | 4 | 5 | 1 |
| EXPERIMENT 2 | 3 | 4 | 4 | 4 | 4 |
| EXPERIMENT 3 | 3 | 3 | 4 | 3 | 5 |
| EXPERIMENT 4 | 3 | 2 | 4 | 2 | 5 |

FIG. 9A

| NUMBER OF SHEETS | | 1-20 | 21-23 | 24 | 25-27 |
|---|---|---|---|---|---|
| EXPERIMENT 5 | Vf | −800V | −200V | −800V | −200V |
| | Vp | 200V | 100V | 200V | 100V |
| EXPERIMENT 6 | Vf | −900V | −100V | −900V | −100V |
| | Vp | 100V | 200V | 100V | 200V |
| EXPERIMENT 7 | Vf | −1000V | 0V | −1000V | 0V |
| | Vp | 0V | 300V | 0V | 300V |
| COMPARATIVE EXAMPLE (EXPERIMENT 3) | Vf | −1000V | −300V | −1000V | −300V |
| | Vp | 0V | 0V | 0V | 0V |

FIG. 9B

| | EXPERIMENT 5 | EXPERIMENT 6 | EXPERIMENT 7 | COMPARATIVE EXAMPLE |
|---|---|---|---|---|
| NUMBER OF JOBS OF TONER CONTAMINATION OCCURRENCE | 320 | 410 | EQUAL TO OR MORE THAN 500 | 250 |

FIG. 11A

| NUMBER OF SHEETS | | 1-20 | 21-23 | 24 | 25-27 |
|---|---|---|---|---|---|
| EXPERIMENT 8 | Vf | −1000V | −300V | −1000V | −300V |
| | Vi | 200V | 200V | 200V | 200V |
| EXPERIMENT 9 | Vf | −1200V | −500V | −1200V | −500V |
| | Vi | 200V | 200V | 200V | 200V |
| EXPERIMENT 10 | Vf | −1200V | −500V | −1200V | −500V |
| | Vi | 400V | 400V | 400V | 400V |
| COMPARATIVE EXAMPLE (EXPERIMENT 3) | Vf | −1000V | −300V | −1000V | −300V |
| | Vi | 0V | 0V | 0V | 0V |

FIG. 11B

| | COMPARISON RESULT OF FIXING SMEARED TRAILING EDGE | | | | NUMBER OF JOBS OF TONER CONTAMINATION OCCURRENCE |
|---|---|---|---|---|---|
| NUMBER OF SHEETS | 1ST SHEET | 21ST SHEET | 24TH SHEET | 25TH SHEET | |
| EXPERIMENT 8 | 3 | 3 | 4 | 3 | EQUAL TO OR MORE THAN 500 |
| EXPERIMENT 9 | 4 | 4 | 5 | 4 | 350 |
| EXPERIMENT 10 | 4 | 4 | 5 | 4 | EQUAL TO OR MORE THAN 500 |
| COMPARATIVE EXAMPLE | 3 | 3 | 4 | 3 | 250 |

IMAGE FORMING APPARATUS AND HEAT FIXING APPARATUS

BACKGROUND OF THE INVENTION

1. Field of the Invention

The present invention relates to an image forming apparatus utilizing an image forming process such as an electrophotographic process or an electrostatic recording process, and a heat fixing apparatus for heating fixing, in an image forming process unit of such image forming apparatus, an unfixed toner image formed and borne on a recording material (a transfer material, a printing sheet, a photosensitive sheet or an electrostatic recording sheet).

2. Related Background Art

As a fixing apparatus equipped in an image forming apparatus employing an electrophotographic process or an electrostatic recording process, there is widely employed so-called heat fixing apparatus in which a recording material bearing an unfixed toner image is passed through a nip portion (fixing nip portion) formed by a fixing roller and a pressure roller which are rotated in mutual contact whereby a permanent image is fixed on the recording material.

An example of a conventional heat fixing apparatus is shown in FIG. 12A. Referring to FIG. 12A, a fixing roller 40 constituting heating means is provided with a hollow aluminum core 42 of a thickness of 0.5 to 4 mm for satisfying a mechanical strength, in which a halogen lamp 41 is provided for effecting heating, by a power supply from an unrepresented power source, sufficient for fusing the toner on the recording material from the interior of the hollow core 42.

Also for fixing the toner, on the recording material, thereto without offsetting, a releasing layer 43 of an excellent releasing property such as of polytetrafluoroethylene (PTFE) or perfluoroalkoxy-tetrafluoroethylene copolymer (PFA) is provided on the outside of the hollow core 42. The releasing layer 43 is formed in a tube shape or formed by electrostatic spraying or dip coating.

Also in order to prevent an offset phenomenon generated by a charging of the surface of the fixing roller by the conveying of the recording material, the releasing layer 43 may contain a conductive material such as carbon black. Also the hollow core 42 of the fixing roller 40 is either electrically grounded, or grounded through a diode, or is given a bias by an unrepresented bias applying means, thereby preventing a charging of the surface of the fixing roller leading to generation of an offset image.

Also a thermistor 44 is maintained in contact with the surface of the fixing roller 40 for detecting the surface temperature of the fixing roller, and on/off controls the power supply to the halogen lamp 41 for heating the toner image on the recording material at an appropriate temperature.

On the other hand, a pressure roller 50 is pressed to the fixing roller 40 by unrepresented pressure springs on both ends of a longitudinal direction of the rollers, for pinching and conveying the recording material. The pressure roller 50 is formed, on a metal core 51, by forming an elastic layer molded with silicone rubber or a sponge elastic layer 52 constituted of foamed silicone rubber, and thereon a releasing layer 53 such as of PTFE, PFA or FEP similar to that in the fixing roller, formed as a tube or by coating.

Thus, by the elasticity of the pressure roller 50, a sufficient nip width can be formed between the rollers. A toner image on a recording material P pinched and conveyed in the nip portion can be fixed by a heating from the fixing roller 40.

Japanese Patent Applications Laid-open Nos. 63-313182, 2-157878, 4-44075 and 4-204980 disclose a method of not supplying an electric power to the heat fixing apparatus in a standby state thereby suppressing the electric power consumption, more specifically a heat fixing method by a film heating process in which the toner image on the recording material is fixed across a thin film passed between the heater unit and the pressure roller.

FIG. 12B shows a schematic configuration of a film heating method. More specifically, referring to FIG. 12B, heating means 60 is constituted of a heating member (hereinafter represented as "heater") 61 fixed on a heat-resistant stay holder (support member) 62, and a thin film (hereinafter represented as "fixing film") resistant to the heat of the heater 61, and, in order to form a nip portion (fixing nip portion) of a predetermined nip width, a predetermined pressure is given to the elastic pressure roller 50 by unrepresented pressurizing means.

The heater 61 is constituted by forming, on a ceramic substrate such as of alumina, a heat-generating resistance layer and a protective layer such as a glass layer or a polyimide layer, and is heated by a current supply and controlled at a predetermined temperature by temperature detecting means 64 provided on a rear surface of the heater 61. A fixing film 63 is a cylindrical or endless belt, or a rolled web member, which is conveyed in a direction indicated by an arrow in sliding contact with the surface of the heater 61 at the fixing nip portion, by unrepresented drive means or by a rotating force of the pressure roller 50.

In a state where the heater 61 is heated and controlled at the predetermined temperature and the fixing film 63 is conveyed in the direction indicated by the arrow, a recording material constituting a member to be heated and bearing an unfixed toner image is introduced between the fixing film 63 and the pressure roller 50 at the fixing nip portion, whereupon the recording material is conveyed through the fixing nip portion in contact with and together with the fixing film 63. In the fixing nip portion, the recording material and the toner image are heated by the heater 61 through the fixing film 63 whereby the toner image on the recording material is heated and fixed. After passing the fixing nip portion, the recording material is separated from the surface of the fixing film 63 and is conveyed.

The fixing film 63 is made as considerably thin as 20 to 70 $\mu$m, in order to supply the recording material, constituting the member to be heated, with the heat from the heater 61 in the fixing nip portion. The fixing film 63 has, as shown in FIG. 13A, a three-layered structure of a film base layer 63*a*, a conductive primer layer 63*b* and a releasing layer 63*c*, in which the film base layer 63*a* is positioned at the side of the heater and the releasing layer 63*c* is positioned at the side of the pressure roller 50.

The film base layer 63*a* is constituted of an insulating resinous film such as of polyimide, polyamidimide or PEEK, or a thin metal film such as of SUS or Ni, and is formed with a thickness of about 15 to 60 $\mu$m having a heat resistance, a high elasticity and a flexiblity.

Also the film base layer 63*a* ensures a mechanical strength, such as a tear strength, of the entire fixing film 63.

The conductive primer layer 63*b* is formed by a thin layer of a thickness of 2 to 6 $\mu$m, and is electrically grounded or connected with a diode or a bias applying means in order to prevent charging of the entire fixing film.

The releasing layer 63*c* is a layer for preventing toner offset to the fixing film 63, and is formed by coating a fluorinated resin of satisfactory releasing property such as PFA, PTFE or FEP with a thickness of about 5 to 10 $\mu$m. Also as in the fixing roller, in order to reduce the charging on the surface of the fixing film 63 thereby preventing an electrostatic offsetting, the releasing layer contains a conductive material such as carbon black of a specific resistivity of about $10^3$ to $10^6$ Ωcm.

Also the pressure member 50 has a configuration similar to that of the pressure roller of the heat fixing apparatus of the aforementioned fixing roller type.

In the heat fixing apparatus of the above-described film heating type, the heater is not powered during a standby state but is powered and rapidly heated to a fixable temperature during a period from a reception of a print signal by the image forming apparatus to the arrival of a recording material to the fixing nip portion, whereby the unfixed toner image on the recording material can be heat fixed and a power saving can be attained.

However, the recording material has recently been used in various types, and has diversified in thickness, surface property, resistance etc. For this reason, various drawbacks are encountered in the heat fixing step in the heat fixing apparatus of the image forming process, and have been avoided by various configurations.

For example, in the heat fixing apparatus of the aforementioned prior configuration, at the entry of the recording material into the fixing nip portion, there may result a phenomenon that the unfixed toner image on the recording material scatters in a direction opposite to the conveying direction of the recording material (hereinafter represented as "fixed image tailing"). A mechanism of generation of such fixed image tailing will be explained with reference to FIG. 13B.

As shown in FIG. 13B, the fixed image tailing is generated by a fact that moisture contained in the recording material P is vaporized by a rapid heating in the fixing nip portion and the unfixed toner image T on the recording material P prior to entering the fixing nip is blown off by thus generated vapor 80 in a direction opposite to the conveying direction of the recording material to generate an image defect, which is apt to be generated particularly in a high humidity environment, when the recording material P has a high moisture content and when the image pattern is a lateral line image with a larger line width and a larger toner amount in the unfixed toner image T.

It is also known that such fixed image tailing aggravates in case the vapor generation 80 from the recording material becomes stronger with an increase in the speed of the image forming apparatus.

In the following, there will be shown a configuration for alleviating the fixed image tailing. As shown in FIGS. 12A and 12B, a discharge rubber roller 71 and a discharge roller 72 are provided in a pair, at a downstream side of the fixing nip portion formed by the heating means 40 or 60 and the pressure roller 50, and serve to convey the recording material discharged from the fixing nip portion. The discharge rubber roller 71 is formed by a conductive rubber member and is in an electrically grounded state. Otherwise a brush-shaped grounded conductive member is positioned at the downstream side of the fixing nip so as to be contacted with the recording material during conveying.

Also in the prior configuration explained in the foregoing, the hollow core 42 of the fixing roller 40 and the conductive primer layer 63*b* of the fixing film 63 are given a bias of a polarity same as that of the unfixed toner image by unrepresented bias applying means. Thus, as the recording material passes the fixing nip portion and contacts the conductive discharge rubber roller 71, a current path is formed through the recording material P to generate a voltage drop between the fixing roller 40 or the fixing film 63 and the recording material P, and an electric field thus generated enhances a supporting power for the unfixed toner image on the recording material, thereby preventing the fixed image tailing.

However, in case the speed of the image forming apparatus easily causing such fixed image tailing is increased, it is necessary to increase the voltage drop between the fixing roller 40 or the fixing film 63 and the recording material P in order to prevent the fixed image tailing, so that it is necessary to increase the bias applied to the hollow core 42 of the fixing roller 40 or the conductive primer layer 63*b* of the fixing film 63 thereby generating a larger current in the current path formed through the recording material.

However, in the above-explained configuration of forming a current path between the hollow core 42 of the fixing roller 40 or the conductive primer layer 63*b* of the fixing film 63 and the conductive discharge rubber roller 71 through the recording material, an eventual excessive current in the current path causes a charge injection, to the toner immediately after the fixing nip, of a polarity opposite to the charging polarity, whereby the toner is inverted in the polarity and becomes easily sticking to the fixing roller 40 or the fixing film 63, thereby causing a toner contamination.

In a low-cost heat fixing apparatus not equipped with cleaning means for the surface of the fixing roller 40 or the fixing film 63, the toner contamination is gradually accumulated on the fixing roller 40 or the fixing film 63, or on the pressure roller 50 maintained in contact therewith through heat fixation of a large amount of the recording materials, and thus accumulated toner may occasionally deposited onto the recording material (hereinafter called "blobs") thereby resulting in an image defect.

Also in case a large potential difference is constantly formed between a conductive part of the fixing roller 40 or the fixing film 63 and a conductive part of the pressure roller 50, substances conveyed by the recording material to the fixing nip, such as paper powder, dusts, fibers from the recording paper and powder scraped off from the photosensitive drum of the image forming unit, may be deposited by an electrostatic force to the surface of the fixing member or the pressure member. Such phenomenon deteriorates the original releasing property, thus enhancing the offset phenomenon or the toner contamination.

SUMMARY OF THE INVENTION

An object of the present invention is to solve the aforementioned drawbacks. Another object of the present invention is to provide a heat fixing apparatus and an image forming apparatus capable of alleviating a fixed image tailing phenomenon, also reducing the amount of toner, paper powder, dust etc. deposited on the surface of the fixing member, and not causing an image defect such as blobs by toner contamination.

The aforementioned objects can be attained, according to the present invention, by a heat fixing apparatus for fixing an unfixed image formed on a recording material, including:

a fixing member;

a pressure member maintained in contact with the fixing member to form a fixing nip through which the recording material bearing the unfixed image is passed;

a conductive member maintained in contact with the recording material at a downstream side of the fixing nip in a conveying direction of the recording material; and bias applying means for applying a bias voltage to at least either of the fixing member and the conductive member;

wherein the bias applying means, in case image formations on a plurality of recording materials are executed in continuation, increases and decreases the bias voltage in the course of the image formations executed in continuation.

Preferably, the image formation on the recording material is judged to be executed in continuation in case a situation continues where a supply of a succeeding recording material is started before a trailing end of a preceding recording material passes through the fixing nip portion.

Preferably, the aforementioned bias applying means includes:

first bias applying means for applying, to the fixing member, a bias of a polarity same as that of the toner; and second bias applying means for applying, to the conductive member or the pressure member, a bias of a polarity opposite to that of the toner;

wherein, in heat fixing the recording materials supplied in continuation in the fixing nip portion, each of the first bias applying means and the second bias applying means increases and decreases the generated bias voltage for every constant or variable number of sheets.

Preferably, when the fixing member and the pressure member are in a direct contact without a recording material therebetween in a gap between a preceding recording material and a succeeding recording material, a direction of an electric field between the fixing member and the pressure member is inverted in comparison with a direction of an electric field in a state where a recording material is present in the fixing nip portion.

Preferably, a rectifying element is connected to a conductive portion of the pressure member to maintain, at the heat fixing of a recording material, the conductive portion of the pressure member at a polarity opposite to that of the toner.

An image forming apparatus of the present invention is an image forming apparatus capable of forming an image by conveying a recording material to an image forming unit and fixing an unfixed image to the recording material by conveying the recording material to a heat fixing apparatus;

wherein an above-described heat fixing apparatus is equipped as the heat fixing apparatus.

In such configuration, in an operation of heat fixing recording materials in continuation and in an early stage of the continuous operation where a fixed image tailing phenomenon tends to appear, a current path is formed between a fixing member and a conductive member positioned in the downstream side of the fixing member through the recording material, thereby generating an electric field by a voltage drop between a conductive portion of the fixing member and the recording material whereby a binding force of the unfixed toner image to the recording material is increased to prevent generation of the fixed image tailing phenomenon.

BRIEF DESCRIPTION OF THE DRAWINGS

FIGS. 7A and 7B are tables showing experimental results in the first embodiment of the present invention;

FIGS. 9A and 9B are tables showing experimental results in the second embodiment of the present invention;

FIGS. 11A and 11B are tables showing experimental results in the third embodiment of the present invention;

DESCRIPTION OF THE PREFERRED EMBODIMENTS (First Embodiment)

Figure 1:
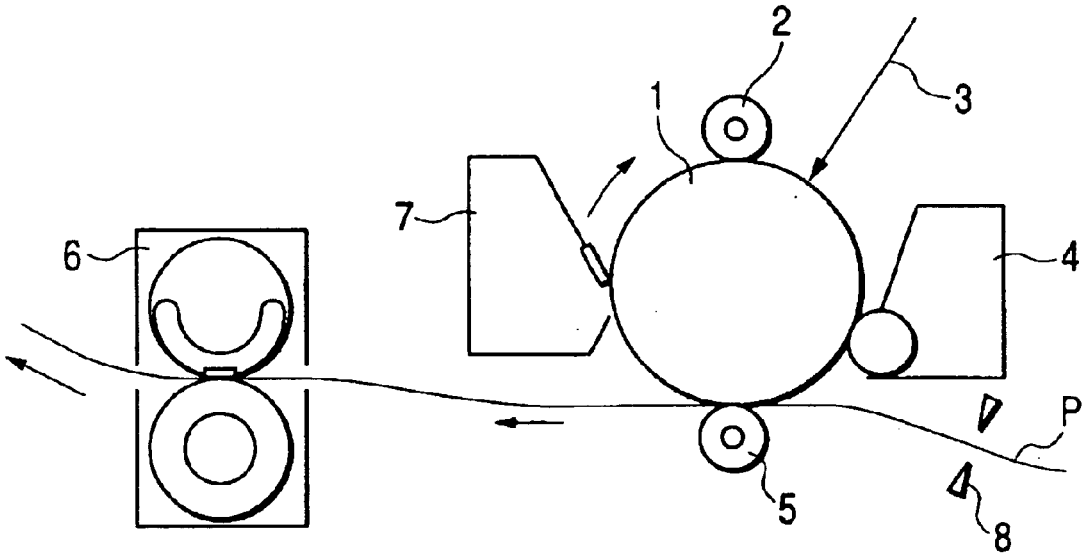
FIG. 1 is a view showing the configuration of an image forming apparatus constituting a first embodiment of the present invention.

In the following, there will be explained embodiments of the present invention. FIG. 1 is a view showing the configuration of an image forming apparatus of a first embodiment.

{Explanation on the Entire Image Forming Apparatus}

Referring to FIG. 1, a photosensitive drum 1 is constituted of a photosensitive material such as OPC, amorphous Se or amorphous Si on a cylindrical substrate such as of aluminum or nickel.

The photosensitive drum 1 is rotated in a direction indicated by an arrow, and is at first surfacially charged uniformly with a charging roller 2 constituting a charging apparatus. Then a scanning exposure by a laser beam 3 which is on-off controlled according to image information is executed to form an electrostatic latent image.

The electrostatic latent image is developed and rendered visible in a developing apparatus 4. The development is executed for example by a jumping development, a two-component development or a feed development, and a combination of an imagewise exposure and a reversal development is often employed.

A visible toner image thus obtained is transferred, by means of a transfer roller 5 serving as a transfer apparatus, from the photosensitive drum 1 onto a recording material P conveyed at a predetermined timing. A top sensor 8 detects a leading end of the recording material controls a timing in such a manner that an image forming position of the toner image on the photosensitive drum 1 coincides with a writing start position of the leading end of the recording material. The recording material P conveyed at a predetermined timing is pinched and conveyed under a constant pressure between the photosensitive drum 1 and the transfer roller 5. The recording material P bearing the transferred toner image is conveyed to a fixing apparatus 6, in which the toner image is fixed as a permanent image.

On the other hand, a residual toner, not transferred but remaining on the photosensitive drum 1 is removed from the surface of the photosensitive drum 1 by a cleaning apparatus 7.

{Heat Fixing Apparatus}

Figure 2:
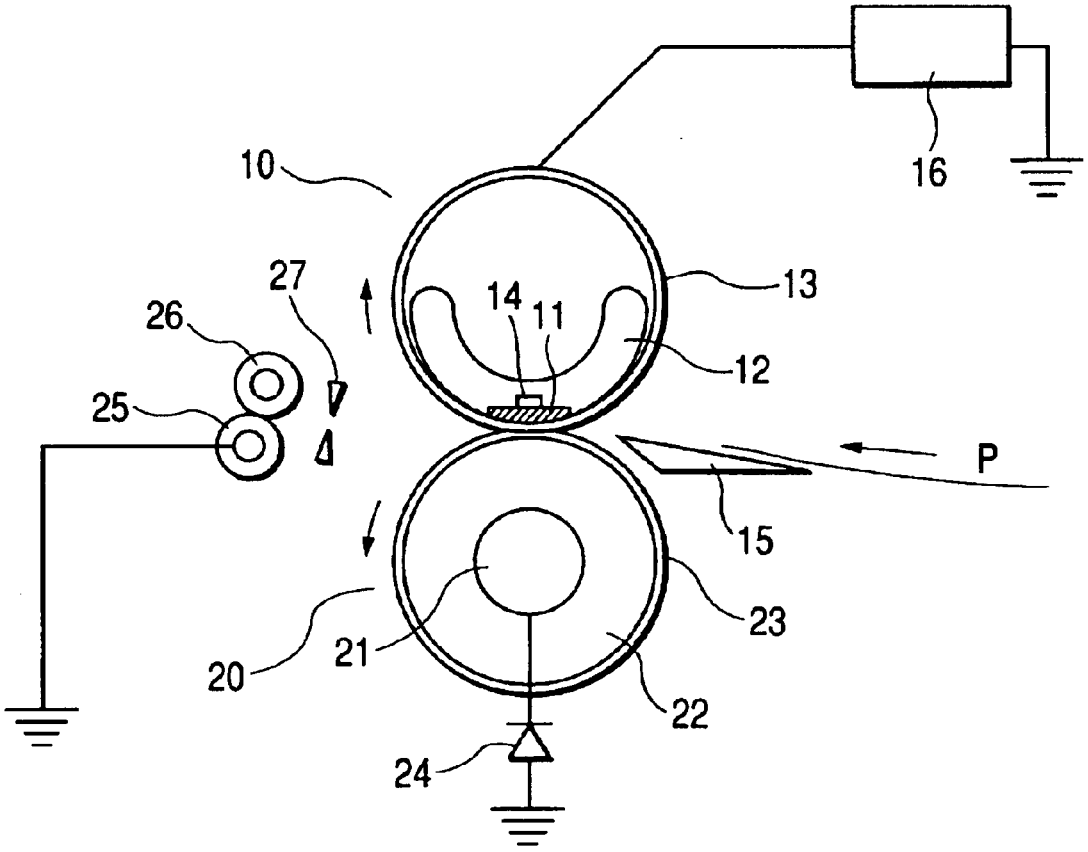
FIG. 2 is a cross-sectional view of a heat fixing apparatus of the first embodiment of the present invention.

FIG. 2 shows a configuration of a heat fixing apparatus of the present embodiment. In FIG. 2, a fixing member 10 is constituted of following members.

A fixing film 13 of a small heat capacity is formed by a heat-resistant film of a total thickness not exceeding 100 $\mu$m in order to enable a quick start. A base layer 13*a* is formed by a heat-resistant resin such as polyimide, polyamidimide or PEEK, or a metal member of a high thermal conductivity such as SUS, Al, Ni, Ti or Zn either singly or as a composite.

Figure 3:
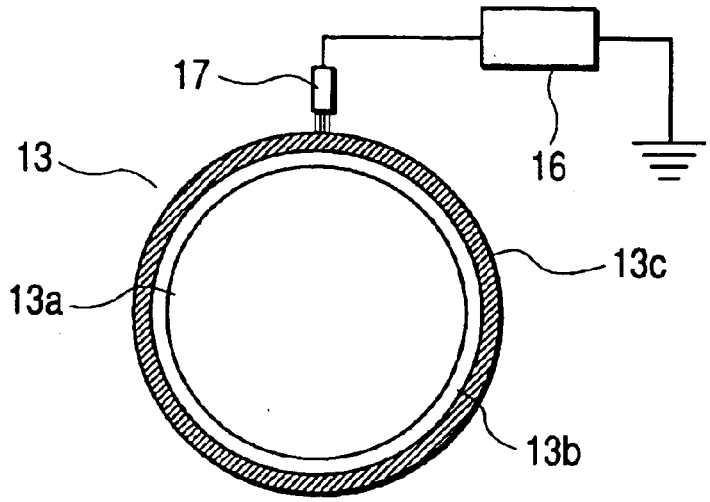
FIG. 3 is a view showing a cross section of a fixing film and bias applying means in the first embodiment of the present invention.

In case of a base layer 13*a* of a resinous material, a powdered material of a high thermal conductivity such as BN, alumina or Al may be mixed in order to improve the thermal conductivity. Also as a base layer 13*a* having a sufficient strength and an excellent durability for constituting a fixing film 13 of a long service life, there is required a total thickness of 20 $\mu$m or larger. Therefore a total thickness of the fixing film 13 is optimally within a range from 20 to 100 $\mu$m. Also for securing prevention of offset phenomenon and separation of the recording material, a releasing layer 13*c* is formed on the surface, as shown in FIG. 3, by coating a heat-resistant resin with satisfactory releasing property for example a fluorinated resin such as PTFE (polytetrafluoro-ethylene), PFA (tetrafluoroethylene-perfluoroalkylvinyl ether copolymer), FEP (tetrafluoroethylene-hexafluoropropylene copolymer), ETFE (ethylene-tetrafluoroethylene copolymer), CTFE (polychlorotrifluoroethylene), or PVDF (polyvinylidene fluoride), or silicone resin either singly or in combination.

The releasing layer 13*c* contains a conductive material such as carbon black or an ionic conductive material, and is coated with a thickness of about 5 to 20 $\mu$m with a specific resistivity of $1\times10^{7}$ to $1\times10^{14}$ Ωcm. It is formed for example by coating a conductive primer layer 13*b* serving as an adhesive on the external surface of the base layer 13*a,* and coating the releasing layer 13*c,* in such a manner that at least either of the base layer 13*a* and the primer layer 13*b* is constituted of a conductive member. The conductive primer layer 13*b* contains a dispersed conductivity providing material such as carbon black, and is formed with a thickness of 2 to 10 $\mu$m and with a specific resistivity of $1\times10^{5}$ Ωcm or less.

A heater 11 is provided inside the fixing film 13 employing the aforementioned base layer 13*a* as a base material, and is-contacted with the internal surface of the fixing film 13 at the fixing nip portion thereby heating the nip portion to fuse and fix the toner image on the recording material conveyed to the fixing nip portion. The heater 11 is formed by forming, on a side of the fixing nip or an opposite side of a heat conductive substrate constituted of a ceramic material such as alumina or AlN and along a longitudinal direction thereof, a heat-generating resistor layer constituted of a conductive material such as Ag/Pd (silver-palladium), Ni/Cr, $RuO_2$, $Ta_2N$ or $TaSiO_2$ and matrix component such as glass or polyimide, by screen printing, evaporation, sputtering, plating or metal foil adhesion in a linear or stripe-shaped arch form. A heating temperature by the heater 11 is detected by temperature detecting means 14 such as thermistor and is controlled at a predetermined temperature.

On the heat-generating resistor layer, there is formed an insulating protective layer of a heat-resistant material such as polyimide, polyamidimide, PEEK or glass. Also in a portion, at the side of the fixing nip, coming in a sliding contact with the fixing film, there may be provided a slidable layer formed by coating a fluorinated resin such as PTFE (polytetrafluoroethylene), PFA (tetrafluoroethylene-perfluoroalkylvinyl ether copolymer), FEP (tetrafluoroethylene-hexafluoropropylene copolymer), ETFE (ethylene-tetrafluoroethylene copolymer), CTFE (polychlorotrifluoroethylene), or PVDF (polyvinylidene fluoride), or a resin such as polyimide or polyamidimide either singly or as a mixture, or by thinly coating or evaporating a dry film lubricant such as graphite or molybdenum disulfide, glass or DLC (diamond-like carbon). In this manner, the fixing film can smoothly glide on the heater with a low frictional coefficient. Otherwise, there may be adopted a configuration of maintaining a surface roughness of a surface of the heat conductive substrate, in sliding contact with the fixing film, at a predetermined value or less, and securing a slidability with lubricating grease or the like while suppressing the heat resistance, thereby improving the thermal efficiency.

A heat-insulating stay holder 12 is provided to support the heater 11 and to prevent heat dissipation to a direction opposite to the fixing nip, and is formed by a heat-resistant resin such as of a liquid crystal polymer, a phenolic resin, PPS or PEEK, and the fixing film 13 is loosely fitted therearound with a margin so as to be rotatable in a direction indicated by an arrow.

A pressure roller 20 serving as a pressure member is constituted of a metal core 21 for example of SUS, SUM or Al, and an elastic layer 22 of a heat-resistant rubber such as silicone rubber or fluorinated rubber, or foamed silicone rubber, in which a conductive material is preferably dispersed, and a releasing layer for example of PFA, PTFE or FEP may be formed thereon.

The pressure roller 20 is sufficiently pressurized toward the fixing member 10 by pressurizing means such as unrepresented pressing springs on both ends of the longitudinal direction, so as to form a nip portion necessary for heat fixation. The pressure roller 20 is rotated by unrepresented drive means from a longitudinal end of the metal core 21. As a result, the fixing film 13 loosely fitted, with a margin, around the external periphery of the heat-insulating stay holder 12 is rotated by a friction with the external periphery of the pressure roller 20.

Variable bias applying means 16 is provided, as shown in FIG. 3, for supplying an electric power to the conductive primer layer of the fixing film 13 for example by a conductive brush 17, and is capable of supplying the conductive layer of the fixing film with a predetermined voltage of a polarity same as that of the unfixed toner according to a state such as a number of the conveyed recording materials.

Referring to FIG. 2, a conductive discharge rubber roller 25 and a discharge roller 26 are provided at a downstream side of the fixing nip, as paired rollers for pinching and conveying the recording material P discharged from the fixing nip. The conductive discharge rubber roller 25 is constituted of a metal core for example of aluminum and a rubber formed by dispersing a conductivity providing material such as carbon black in heat-resistant rubber such as silicone rubber, and such conductive rubber is given a conductivity of $1\times10^{6}$ Ω or less.

The metal core of the conductive discharge rubber roller 25 is electrically grounded, and forms a predetermined potential difference to a voltage applied by the bias applying means 16 to the conductive primer layer 13*b* of the fixing film 13, whereby a current path is formed between the discharge rubber roller 25 and the conductive primer layer 13*b* of the fixing film 13 while the recording material P is in contact with the fixing nip and the discharge rubber roller 25.

The present embodiment employs a conductive discharge rubber roller 25, but the conductive member in contact with the recording material may also be formed by a conductive brush, a conductive guide or the like, and there may be employed a member of any shape capable of generating a potential difference to the conductive primer layer 13*b* of the fixing film 13 thereby forming a current path through the recording material.

Also the metal core 21 of the pressure roller 20 is connected to a rectifying element 24 such as a diode so as to induce a charge of a polarity opposite to that of the toner in the metal core 21 and the conductive elastic layer 22 of the pressure roller, whereby a predetermined potential difference is generated between the conductive primer layer 13*b* of the fixing film 13 and the conductive elastic layer 22 of the pressure roller 20.

A discharge sensor 27 detects the discharge of a recording material from the fixing nip. The presence of the rectifying element 24 between the conductive member of the pressure roller 20 and the ground allows to stabilize the potential on the surface of the pressure roller 20, and is therefore effective in suppressing fluctuations among the apparatuses and stabilizing the offset phenomenon.

Even in case the bias voltage applied to the conductive primer layer 13*b* of the fixing film 13 is lowered in the middle of an operation, the charge of the polarity opposite to that of toner, induced on the conductive elastic layer 22 of the pressure roller 20, is gradually dissipated by the function of the rectifying element 24, whereby the charge of the polarity opposite to that of the toner is retained for a predetermined time.

In the heat fixing apparatus of the above-described configuration, a recording material P is suitably supplied by unrepresented supply means and is conveyed, along a heat-resistant entrance guide 15, into the fixing nip formed by the heating member 10 and the pressure member 20. Thereafter, the recording material P discharged from the fixing nip is pinched and conveyed by the conductive discharge roller 25 and the discharge roller 26, and is discharged along an unrepresented heat-resistant discharge guide onto an unrepresented discharge tray.

Also while the recording material P is subjected to heat fixation in the fixing nip, the bias applying means 16 applies a predetermined bias to the conductive primer layer of the fixing film, based on signal from a top sensor 8 and a discharge sensor 27 for detecting the leading end position of the recording material.

{Fixing Bias}

Figure 4:
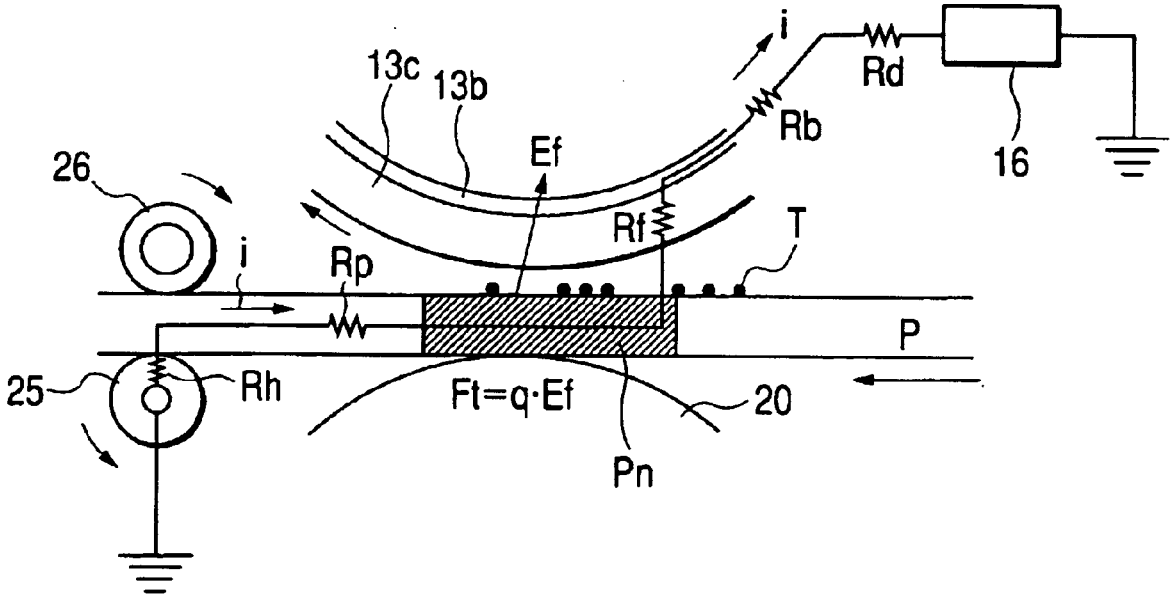
FIG. 4 is an equivalent circuit diagram of a vicinity of a fixing nip portion.

FIG. 4 is a view showing principal parts of a fixing apparatus of the present embodiment and indicating an equivalent circuit in case a recording material P, bearing a transferred and unfixed toner T, is introduced into the fixing nip portion in a state where a DC bias of a polarity same as that of the toner is applied by the bias applying means 16 to the conductive primer layer 13*b* of the fixing film 13. The application of the bias to the conductive primer layer 13*b* of the fixing film 13 is executed by an current supply member such as a conductive brush shown in FIG. 3 or an unrepresented conductive rubber ring, in contact with the conductive primer layer 13*b*, and a protective resistor Rd is connected between an output end of the bias applying means 16 and the conductive primer layer 13*b*. Rb indicates a contact resistance between the current supply member and the conductive primer layer 13*b* and a resistance of the conductive primer layer 13*b* to the vicinity of the fixing nip portion, and Rf indicates a resistance of the releasing layer 13*c* of the fixing film 13.

In an area Pn close to the fixing nip portion, the recording material P such as paper is heated to generate water vapor, whereby the electrical resistance in the area Pn is lowered and becomes negligibly small in comparison with other serially connected resistances in the equivalent circuit, so that the area Pn can be regarded to have a same potential.

The recording material after passing the fixing nip portion is lowered in moisture content, so that the resistance is no longer negligible and a resistance to the discharge rubber roller 25 constituting a grounding electrode is represented by Rp. Also a contact resistance of the discharge rubber roller 25 constituting the grounding electrode with the recording material P and a resistance to the ground are represented by Rh.

In case a bias V is applied by the bias applying means 16 to the conductive primer layer 13*b* of the fixing film 13 in the aforementioned equivalent circuit, the conductive primer layer 13*b* of the fixing film 13 assumes a potential Vn somewhat lower than the applied bias V in the vicinity of the nip portion, because of a voltage drop by the resistances Rd and Rb.

A current i flows between the potential Vn of the conductive primer layer 13*b* of the fixing film 13 and the ground potential V0 through the releasing layer 13*c*, the recording material P and the discharge rubber roller 25 serving as the grounding electrode, thereby generating an electric field Ef between the conductive primer layer 13*b* and the even potential portion Pn of the recording material P. Such electric field exerts a binding force $Ft=q\cdot Ef$, proportional to a charge amount q of the toner T, on the unfixed toner image to the recording material P, thereby enabling to prevent image defects such as the fixed image tailing and the toner scattering.

Also in a continuous printing operation in which the image forming apparatus receives print signals and executes heat fixation of unfixed toner images in continuation, particularly in an early stage of the continuous printing operation in which the vapor is not yet saturated, the recording material conveyed between the transfer portion and the fixing portion in the image forming apparatus discharges vapor but shows a high resistance Rp immediately after the heat fixation since the vapor is not yet saturated in the vicinity of the fixing nip, so that a current scarcely flows from the conductive primer layer 13*b* of the fixing film 13 to the discharge rubber roller 25 serving as the grounding electrode.

A continuous printing means a state where the recording materials of a finite length are conveyed by the supply means in succession to the image forming portion and the heat fixing portion without interruption of the image forming apparatus, and more specifically indicates a state where, when a trailing end of a preceding recording material passes through the fixing portion or the discharge sensor 27 of the heat fixing apparatus shown in FIG. 2, a supply of a succeeding recording material is started from the supply means of the image forming apparatus.

In case the succeeding recording material is conveyed in continuation, the vicinity of the fixing is filled with the vapor discharged from the previously conveyed recording material. The amount of vapor increases as the number of the continuously conveyed recording materials increases. Consequently, in a latter part of the continuous printing operation, a current flow easily from the conductive primer layer 13*b* of the fixing film 13 to the discharge rubber roller 25 serving as the grounding electrode.

Also in an early stage of the continuous printing operation, the air pressure in front of the fixing nip portion is lower because of a low vapor amount in the vicinity of the fixing portion, so that the vapor generated in the fixing nip portion tends to be generated strongly in front of the nip portion.

Based on these facts, in case the bias voltage V applied by the bias applying means is constant, the fixed image tailing phenomenon tends to be generated in an early stage of the continuous printing operation but becomes reduced in a latter stage of the continuous printing operation.

Also, since the fixing nip portion is heated at a high temperature, the vapor filled therearound does not easily become water drops in the vicinity of the fixing nip portion, and is discharged within several seconds from the apparatus in case a cooling fan or the like is provided in the image forming apparatus. Therefore, the state before and after the fixing nip portion returns to the initial state of the continuous printing operation in case the recording materials are supplied with an interval in the image forming apparatus.

Based on the foregoing, the fixed image tailing phenomenon can be suppressed by applying a large bias to the conductive primer layer 13*b* of the fixing film 13 in order to generate a large current, but such large applied bias causes an excessively current from the discharge rubber roller 25 to the conductive primer layer 13*b* of the fixing film 13 through the recording material particularly in a latter stage of the continuous printing operation to inject a charge into the toner immediately after the fixing nip, thereby causing an inversion of the potential prior to the entry into the fixing nip and resulting in a drawback of offsetting of the toner image from the recording material to the surface of the fixing film. Particularly in case the continuous printing operation is continued with an increase in the amount of the toner images transferred onto the fixing film, a toner contamination is accumulated on the fixing film or on the pressure roller 20 as a result of toner transfer from the fixing film 13 in an interval (gap) of the conveyed recording materials, and such toner contamination is eventually discharged onto a recording material to cause an image defect.

Particularly in case a high applied bias is maintained to the conductive primer layer 13*b* of the fixing film 13 during the continuous printing operation, toner transferred from the recording material and other substances such as paper powder, dusts, fibers and scraped powder of the photosensitive drum 1 are firmly deposited strongly onto the surface of the fixing film or the pressure roller, thereby deteriorating the releasing property of such surface and further accelerating the deposition of the toner or the like, whereby an image defect such as blobs is generated even in a relatively short heat fixing process.

Therefore, the present embodiment is characterized, in case of heat fixing the recording materials in continuous manner, by elevating and lowering the voltage generated by the bias applying means according to a number of the continuously conveyed recording materials, in order to maintain a large potential difference or a small potential difference between the conductive primer layer 13*b* of the fixing film 13 and the discharge rubber roller 25 serving as the grounding electrode or the conductive member of the pressure roller 20 according to a number of the continuous printing operations.

Figure 5:
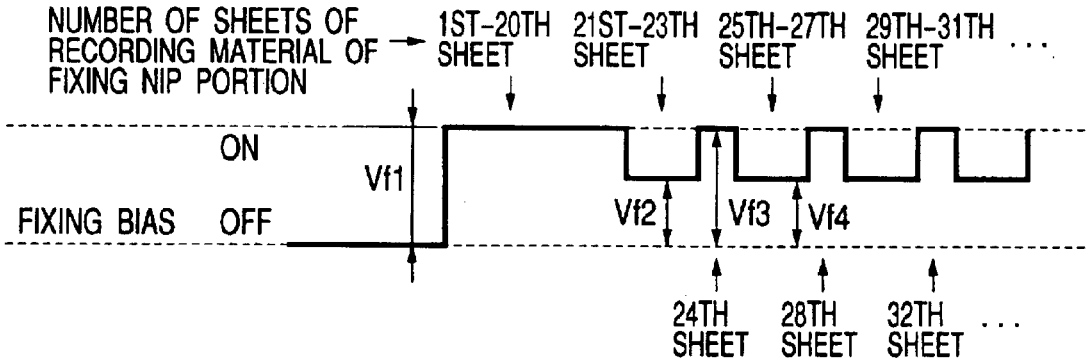
FIG. 5 is a timing chart of a fixing-bias.

FIG. 5 is a timing chart of a bias application in the present embodiment. Referring to FIG. 5, the bias applied to the conductive primer layer 13*b* of the fixing film 13 is increased or decreased according to a number of the recording materials conveyed to the fixing nip portion in a continuous printing operation, and is thus set at Vf1 for 1st to 20th sheets, then at Vf2 (Vf1>Vf2) for 21st to 23rd sheets, at Vf3 (Vf2<Vf3) for a 24th sheet, at Vf4 (Vf3>Vf4) for 25th to 27th sheets, and Vf3 and Vf4 are repeated thereafter for a predetermined number of sheets. Vf1 and Vf3, or Vf2 and Vf4 may be mutually same biases or may be made mutually different.

Also when the fixing film 13 comes into a direct contact with the pressure roller 20 without a recording material therebetween in the fixing nip portion, for example in a pre-rotation step, in an interval between the recording materials or in a post-rotation step, a small amount of toner deposited on the fixing film tends to be transferred electrostatically to the pressure roller, in case a bias of a polarity same as that of the toner is applied to the fixing film 13. Once the toner is deposited on the pressure roller, it is hardly transferred to a next recording material but is accumulated on the pressure roller, and, when the accumulation increases, the toner may be discharged onto a recording material in a visible size. In order to avoid such phenomenon, the fixing bias is preferably applied principally when the recording material is pinched and conveyed in the fixing nip portion, as shown in FIG. 6A.

Figure 6A:
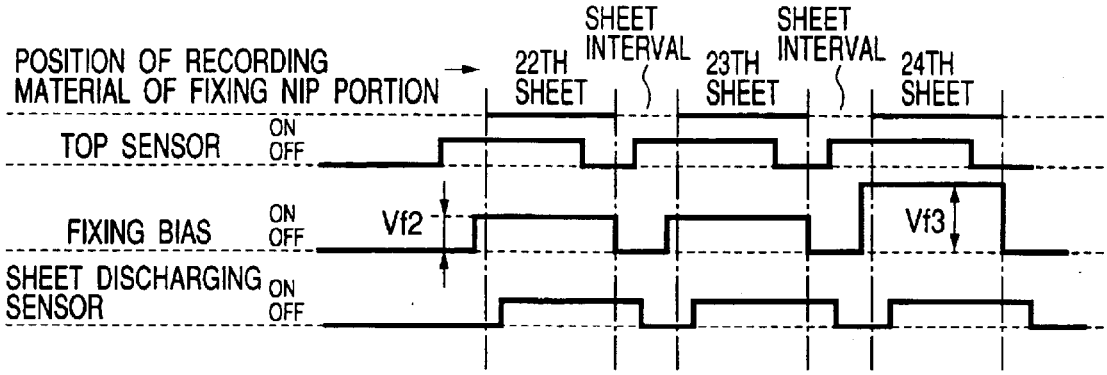
FIGS. 6A, 6B and 6C are timing charts of a fixing bias.

In FIG. 6A, thick lines indicate timings of conveying of the 22nd to 24th recording materials in the fixing nip portion, and there are also shown timings of sensing by the top sensor 8 and the discharge sensor 27 and of bias application. An on-state of each sensor indicates that a recording material is present in the position of each sensor. As shown in the chart, the bias application by the bias applying means 16 to the conductive primer layer 13*b* of the fixing film 13 is started, after the detection of the leading end of the recording material P by the top sensor 8, with a delay equal to or slightly smaller than a time T1 obtained by dividing a distance from an on-position of the top sensor 8 to the fixing nip portion by the conveying speed.

Also the fixing bias by the bias applying means is turned off after a time T2 obtained by dividing a distance from an off-position of the top sensor to the fixing nip portion by the conveying speed, from the detection of the trailing end of the recording material P by the top sensor 8.

The fixing bias is applied to the conductive primer layer 13*b* of the fixing film 13 while the recording material P is conveyed in the fixing nip portion, with a polarity same as that of the toner and with a value Vf2 or Vf3. The applied bias is increased and decreased to Vf2 and Vf3 depending on the number of conveyed recording materials in a continuous printing operation, wherein a lower bias Vf2 reduces a charge injection into the toner image immediately after fixation, and also prevents the fixed image tailing phenomenon. As explained in the foregoing, when vapor is abundantly present in the vicinity of the fixing apparatus, the current flow is facilitated from the fixing film 13 to the conductive member at the downstream side of the fixing nip through the recording material P, whereby the fixed image tailing phenomenon does not extremely aggravate even if the bias applied to the fixing film 13 is reduced.

Also as the conductive elastic layer 22 of the pressure roller 20 is so constructed, by the rectifying element 24, as to generates a charge of a polarity opposite to that of the toner, the charge induced on the conductive elastic layer of the pressure roller 20 is not immediately dissipated but retained for a while even when the applied bias is reduced from a high value Vf1 or Vf3 to a lower value Vf2 or Vf4, whereby the fixed image trailing phenomenon does not aggravate for several sheets in a continuous printing operation.

Also the increase and decrease of the fixing bias to Vf2 and Vf3 in the course of the continuous printing operation increases and decreases an electrostatic adhesion force of the toner and the contaminants such as paper powder, dusts, fibers and scraped powder of the photosensitive drum to the surface of the fixing film or the pressure roller, thereby discharging these contaminating substances onto succeeding recording materials in an invisible level and preventing deterioration of the releasing property of such surface of the fixing film or the pressure roller by an excessive deposition and accumulation of such contaminants.

In particular, the fixing bias not maintained constant but oscillated allows to increase and decrease a potential difference between the fixing film 13 and the pressure roller 20 thereby increasing and decreasing the adhesion force of the contaminating substances deposited on the surface of the fixing film or the pressure roller and facilitating their discharge onto the succeeding recording material, whereby such contaminating substances are prevented from becoming solidified on such surface.

The continuous printing has a same meaning as explained in the foregoing, and a continuous printing operation is judged to have been terminated in case a succeeding recording material is not supplied by the supply means into the image forming apparatus when a trailing end of a preceding recording material has passed the fixing nip and the position of the discharge sensor 27. In case the image forming apparatus thereafter receives a print signal again and the supply of a recording material is started, the bias setting explained in the foregoing is returned to an initial state. As explained in the foregoing, in case a cooling fan or the like is equipped in the image forming apparatus in order to prevent a temperature elevation therein thereby forming an air path in the vicinity of the fixing nip, a vapor saturated state in the vicinity of the fixing nip lasts only for a short period. Therefore such bias setting is to prevent an aggravation of the fixed image tailing phenomenon, in a situation where a current cannot be secured between the fixing film 13 and the conductive member at the downstream side of the fixing nip when the printing operation is re-started.

Thus, in the printing operation in an early stage after restarting of the printing, it is necessary to apply a fixing bias of a predetermined value or higher in order to prevent the fixed image tailing phenomenon. However, it is naturally unnecessary to return the fixing bias setting to the initial state as long as such objective can be attained by any other method.

{Experimental Results}

A following experiment was executed in order to confirm the effect of the present embodiment.

As an image forming apparatus, there was employed a laser beam printer with a conveying speed for the recording material of 250 mm/sec, and capable of forming a toner image on a photosensitive drum by a jumping development with a negatively charged toner in a developing apparatus and forming an image on the recording material by a transfer roller.

In a fixing apparatus, a fixing film 13 formed by coating a conductive primer layer 13*b* with a thickness of 4 $\mu$m on an external periphery of a tubular member of SUS304 with an external diameter of 30 mm and a thickness of 40 $\mu$m, and further forming a releasing layer 13*c* of PFA containing a dispersed conductive member with a thickness of 10 $\mu$m and a specific resistivity of $1\times10^9$ $\Omega\cdot$cm. Also a pressure roller 20 was obtained by forming an elastic layer 22 of conductive silicone rubber with a thickness of 4 mm and an external diameter of 30 mm on an aluminum core of an external diameter of 22 mm, and further providing an insulating PFA tube of a thickness of 40 $\mu$m as an external layer.

The aluminum core 22 of the pressure roller 20 was grounded through a diode as the rectifying element 24, in order to induce a charge of a polarity opposite to that of the toner on the conductive elastic layer 22 of the pressure roller 20.

The experiment was conducted by a continuous printing operation under an application of a bias of a negative polarity, same as the polarity of the toner by the bias applying means to the conductive primer layer 13*b* of the aforementioned fixing metal film 13, and there are compared a level of fixed image tailing and a toner amount deposited and accumulated on the surface on the fixing film and the pressure roller when such bias is changed according to the number of heat fixation of the recording materials.

The level of the fixed image tailing was compared on a first sheet at each change of the bias (namely on 1st, 21st, 24th and 25th sheets), and the accumulated toner amount was compared in the toner contamination on the fixing film and on the pressure roller when 20 jobs of printing was executed in continuation with a pause of 1 minute after each job, a job being a continuous printing of 500 sheets with a 500-sheet cassette.

After a pause, a sheet counter is reset to an initial state and the fixing bias applied by the bias applying means is returned to an initial state. Therefore, the jobs of 500 sheets each are given similar biases.

The bias as a function of number of sheets in each continuous printing operation is shown in the following. The bias application on a 28th sheet and thereafter is made same as in the 24th to 27th sheets. Results are shown in a chart in FIG. 7A.

FIG. 7B shows the results of comparison of the fixed image tailing and the toner contamination in the bias applications. In FIG. 7B, numerals indicate ranks, in which 5 indicates a completely satisfactory level, 4 indicates a slightly defective level, 3 indicates a permissible level, 2 indicates a level in which a defect can be confirmed, and 1 indicates a poor level (levels being same also in following figures). The fixed image tailing was evaluated at an approximately central position of a recording material.

As a result of these experiments, an experiment 1, in which the fixing bias was maintained at −1000 V without change through the continuous printing operation, was satisfactory level in the fixed image tailing but defective in the toner contamination, showing a toner contamination on the recording material starting from a 10th job and a severe toner contamination in a 20th job with blobs generated on the image.

An experiment 2 could maintain a satisfactory state in the fixed image tailing, but showed a certain toner contamination in a 20th job.

An experiment 3 with a large amount of change in the fixing bias did not generate the toner contamination at all, while maintaining the fixed image tailing within a permissible range. The fixed image tailing did not show a large change even in the 21st to 23rd sheets for which the fixing bias was lowered, and conductive elastic layer of the pressure roller did not show an immediate drop in the potential when the fixing bias was changed.

However, in an experiment 4 in which the amount of change of the fixing bias was made even larger, the toner contamination was not observed but the fixed image tailing aggravated somewhat on a 21st or 25th sheet for which the fixing bias was made lower.

As indicated by these results, it is possible to prevent the toner contamination without causing the fixed image tailing, in a continuous printing operation, by suitably elevating and lowering the potential difference between the conductive portion of the fixing film 13, and the conductive member at the downstream side of the fixing nip and the conductive elastic layer 22 of the pressure roller 20.

Also in the foregoing experiments, when the toner contamination was confirmed in a configuration where the diode was not present between the aluminum core 21 of the pressure roller 20 and the ground, a deterioration of about one rank was observed in certain cases. It was therefore confirmed that the presence of the rectifying element 24 in order to induce a charge of a polarity, opposite to that of the toner, on the conductive elastic layer 22 of the pressure roller 20 was effective for avoiding the toner contamination and the fixed image tailing for several sheets after the fixing bias was lowered.

The present embodiment has been explained by a system of applying a fixing bias to the conductive primer layer 13*b* of the fixing film 13, but similar effects can be obtained in a system of applying a bias of a polarity, opposite to that of the toner, to a conductive member positioned at the downstream side of the fixing nip and coming into contact with the recording material P and the conductive elastic layer 22 of the pressure roller 20, or a method of associating the bias applying means to the present embodiment, by similarly elevating and lowering the bias at the continuous printing operation.

Also in the present embodiment, there has principally been explained a heat fixing apparatus utilizing a fixing film, but similar effects can naturally be obtained also in a heat fixing apparatus utilizing a heating roller, as long as a current path is formed between a fixing member and a conductive member provided at the downstream side of the fixing nip and coming into contact with the recording material.

(Second Embodiment)

In the following there will be explained a second embodiment of the present invention. The entire configuration of the apparatus is similar to that of the first embodiment shown in FIG. 1, and, among the configuration of the heat fixing apparatus, components similar to those of the first embodiment shown in FIG. 2 will not be explained in duplication.

The present embodiment is provided with bias applying means 16 for the conductive member of the fixing film 13 and bias applying means for applying a bias to a conductive member positioned at a downstream side of the fixing nip and to the conductive elastic layer 22 of the pressure roller 20, and is characterized in that a fixing bias is applied by either one of the bias applying means while the recording material P is conveyed through the fixing nip portion, thereby preventing the fixed image tailing and not accumulating the toner and contaminating substances such as paper powder, dusts, fibers and scraped powder of the photosensitive drum on the surface of the fixing film or the pressure roller.

Figure 8:
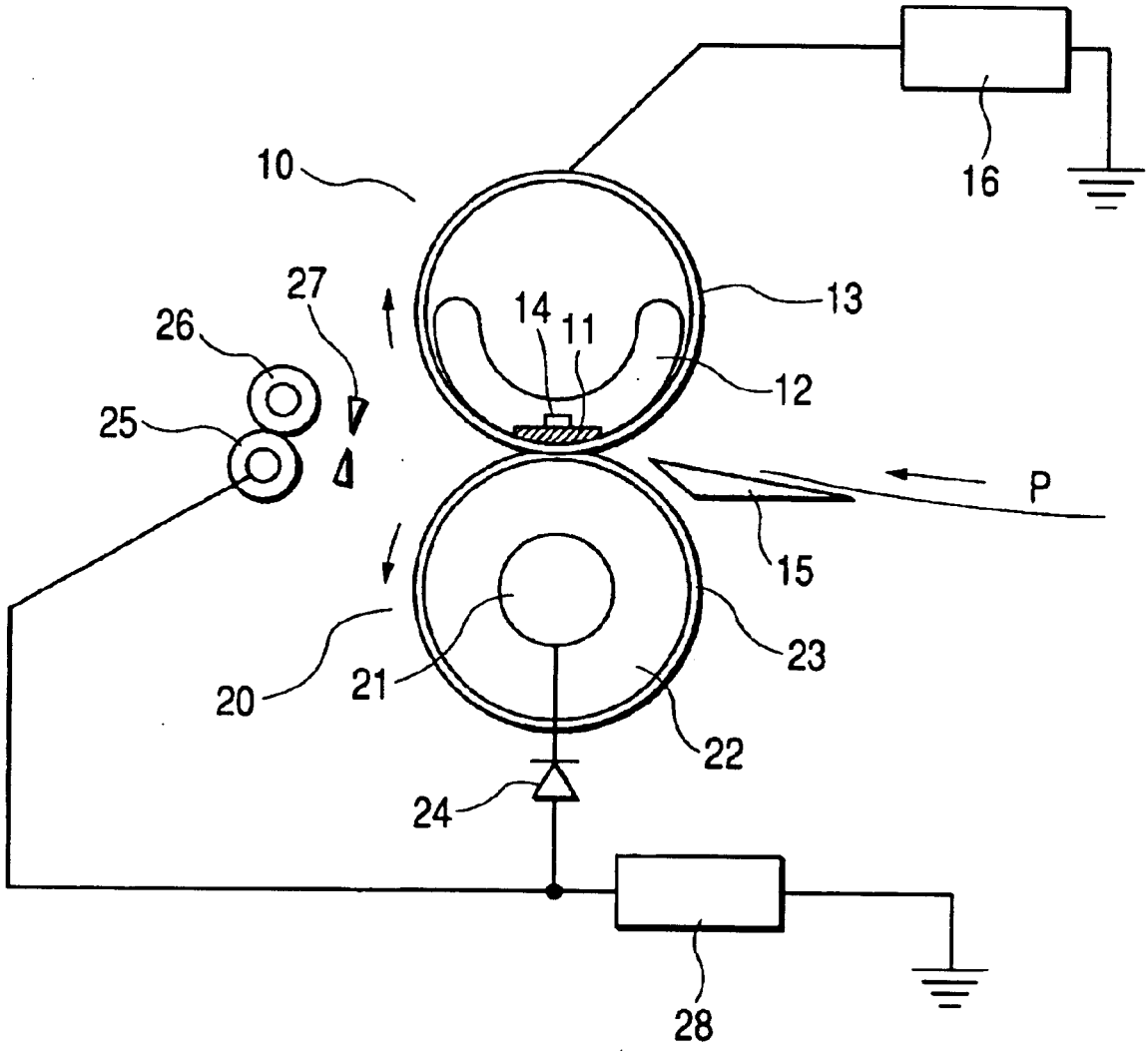
FIG. 8 is a cross-sectional view of a heat fixing apparatus of a second embodiment of the present invention.

The configuration of the heat fixing apparatus of the present embodiment will be explained with reference to FIG. 8. Referring to FIG. 8, a pressure roller 20 is prepared by forming a conductive elastic layer 22 for example of silicone rubber in which a conductive material such as carbon is dispersed on a metal core 21, and by forming thereon an insulating heat-resistant tube for example of PFA as a releasing layer 23, and bias applying means 28 is connected to the metal core 21 of the pressure roller.

Between the bias applying means 28 and the metal core 21 of the pressure roller, there is preferably connected a rectifying element 24 such as a diode.

Also the bias supplying means 28 serves to apply a bias of a polarity opposite to that of the toner to the metal core 21 of the pressure roller 20 and also simultaneously supply a bias to a metal core of the conductive discharge rubber roller 25 positioned at the downstream side of the fixing nip. However, these applied voltages, namely the bias supplied to the metal core of the pressure roller and the bias supplied to the conductive discharge rubber roller 25 may have different voltages, and the bias applying means 28 may be provided separately.

The above-described configuration realizes a case (fixing bias A) in which a bias of a polarity same as that of the toner is applied by the bias applying means 16 to the conductive primer layer 13*b* of the fixing film 13, and a case (fixing bias B) in which a bias of a polarity opposite to that of the toner is applied to the pressure roller 20 and the metal core 21 of the discharge rubber roller.

Figure 6B:
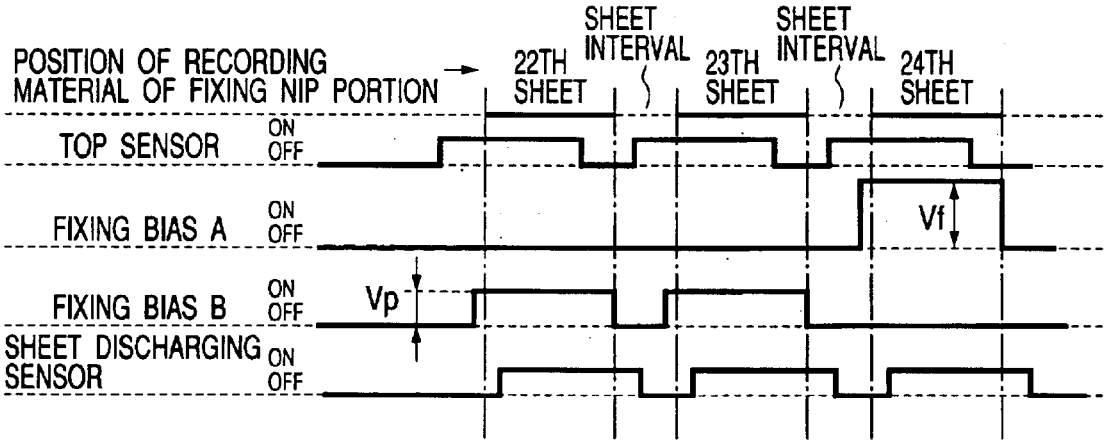

FIG. 6B shows a timing chart of bias application. FIG. 6B shows a situation in a continuous printing operation, where 22nd to 24th recording materials are conveyed to the fixing nip portion. In 1st to 20th sheets in the continuous printing operation, a fixing bias A alone is applied as in the 24th sheet, and, in 21st to 23rd sheets, a fixing bias B alone is applied. Also in 25th and subsequent sheets, fixing biases as in the 21st to 24th sheets are repeatedly applied for every four sheets.

As shown in the drawing, the fixing bias A is a bias to the conductive primer layer 13*b* of the fixing film 13 and applies a bias value Vf1 of a polarity same as that of the toner when the recording material P is conveyed through the fixing nip. Also the fixing bias B is a bias to the metal core 21 of the pressure roller 20 shown in FIG. 8 and a bias to the conductive discharge rubber roller 25 positioned at the downstream side of the fixing nip. Thus the metal core 21 of the pressure roller and the conductive discharge rubber roller 25 are given a bias value Vp of a polarity opposite to that of the toner.

As to the timing of bias application, as shown in FIG. 6B, either one of the fixing biases A and B is applied after the lapse of a predetermined time from a detection of the leading end of the recording material by the top sensor. Also the bias is turned off at a timing when the recording material is discharged from the fixing nip, more specifically after the lapse of a predetermined time from a detection of the trailing end of the recording material by the top sensor.

The above-mentioned bias value Vf or Vp may be made variable, and by increasing and decreasing a potential difference between the conductive primer layer 13*b* of the fixing film 13 and the metal core 21 of the pressure roller 20 or the conductive discharge rubber roller 25 according to the number of heat fixations in a continuous printing operation, there can be obtained an aforementioned effect of improving the fixed image trailing and preventing the accumulation of toner and contaminating substances such as paper powder.

In particular, the present embodiment is so constructed as to apply either one of the fixing biases A and B while the recording material is conveyed in the fixing nip, and an ability for eliminating the contaminating substances is improved by providing a situation where the contaminating substances are positively attracted by an electrostatic force to the surface of the fixing film or the pressure roller and a situation where the heat fixation is executed while such surface is maintained in an almost grounded state thereby decreasing the electrostatic force to the contaminating substances.

More specifically, the conductive layer of the fixing film 13 or the conductive elastic layer 22 of the pressure roller 20, by being brought to a ground state, no longer attracts the contaminating substances with a strong electrostatic force, whereby the contaminating substances stick to and are conveyed by a member with a larger physical sticking force, by a difference in the releasing property between the surface of the fixing film 13 or the pressure roller 20 and the surface of the recording material.

As explained in the foregoing first embodiment, the surface of the fixing film 13 or the pressure roller 20 is constituted of a material with an excellent releasing property such as a fluorinated resin, so that it generally shows a releasing property higher than that of the recording material. Therefore, by eliminating the electrostatic factors as far as possible, the contaminating substances stick more easily to the member of a lower releasing property and can be more easily removed from the apparatus by deposition on the recording material.

In order to confirm the level of deposition and accumulation of the contaminating substances in the fixing bias applying method of the present embodiment, an experiment was conducted with a setting of fixing bias as shown in FIG. 9A.

As the potential difference between the conductive primer layer 13*b* of the fixing film 13 and the conductive discharge rubber roller 25 positioned at the downstream side of the fixing nip, required for attaining a satisfactory level of the fixed image trailing, the experiment 3 showing a better result in the first embodiment was used as reference.

A configuration of the heat fixing apparatus employed for the confirmation and a method of confirming the toner confirmation are similar to those employed in the first embodiment and will not therefore be explained further. Also the continuous printing operation has a same definition as in the first embodiment, and the bias setting was returned to that for the first sheet in case the continuous printing operation was interrupted. There was confirmed when a contamination started to be generated, taking a continuous printing operation of 500 sheets as a job and providing a pause of 1 minute after each job.

Also for the purpose of comparison, a confirmation in the bias applying method (experiment 3) of the first embodiment was executed as a comparative example. In a table shown in FIG. 9A, Vf indicates an applied bias (fixing bias A) to the conductive primer layer 13*b* of the fixing film 13 while the recording material P is conveyed in the fixing nip, while Vp indicates an applied bias (fixing bias B) to the conductive elastic layer 22 of the pressure roller and the conductive discharge rubber roller 25 positioned at the downstream side of the fixing nip. The bias application for 28th and subsequent sheets was made, as in the first embodiment, by repeating the bias application for the 24th to 27th sheets.

Also FIG. 9B shows a result of comparison of start of contamination on the fixing film and on the pressure roller in a continuous printing operation with varied biases.

In the comparative example (experiment 3) utilizing a bias setting same as in the first embodiment, the releasing property on the surface of the fixing film and the pressure roller was lowered by repeating 200 jobs whereby the toner contamination started to be generated though in a slight level. In particular, a slight toner contamination was observed on the fixing film corresponding to an edge section of the paper used as the recording material, perpendicular to the conveying direction thereof. This is because, in case paper is employed as a recording material, paper powder tends to stick to the fixing film or the pressure roller at the edge section of the paper by the bias.

In cut sheets of paper, paper powder is often generated from an edge section by the influence of paper cutting, and an accumulation of such paper powder on the fixing film or the pressure roller deteriorates the releasing property of the surface of the fixing film or the pressure roller, thereby stimulating the toner contamination.

On the other hand, in the experiments 5, 6 and 7, it was rendered possible to delay the start of toner contamination by employing a state of applying the bias to the conductive primer layer 13*b* of the fixing film 13 and a state of applying the bias to the conductive elastic layer of the pressure roller 20 according to the number of sheets in the continuous printing operation, and decreasing either one of such biases while the recording material is conveyed in the fixing nip, depending on the number of sheets. In particular, by applying the fixing bias only from the side of the fixing film at a certain number of sheets and applying the fixing bias from the side of the pressure roller 20 at a certain number of sheets (experiment 7), satisfactory image formation was possible without the toner contamination even after 500 jobs. Also the deposition of paper powder to the surface of the fixing film at a position corresponding to the edge section of paper was also slight.

As explained in the foregoing, the present embodiment is provided with fist bias applying means 16 for applying a fixing bias to the conductive member of the fixing member and second bias applying means 28 for applying a fixing bias to the conductive elastic layer 22 of the pressure roller 20 and the conductive member positioned in the downstream side of the fixing nip and is so constructed that, in a continuous printing operation for the recording materials, the bias application is executed either by the first bias applying means 16 only at the side of the fixing film or by the second bias applying means 28 only at the side of the pressure roller while the recording material is conveyed in the fixing nip, according to the number of fixation of the recording materials, thereby providing a heat fixing apparatus of a long service life capable of preventing deposition and accumulation of substances such as toner, paper powder, dusts, fibers and scraped powder of photosensitive drum, transported by the recording material, onto the surface of the fixing member or the pressure member thereby maintaining the releasing property of such surface and not causing the image defect by contaminating substances such as toner.

(Third Embodiment)

In the following there will be explained a third embodiment of the present invention. Also in this embodiment, the entire configuration of the apparatus is similar to that of the first embodiment shown in FIG. 1, and, among the configuration of the heat fixing apparatus, components similar to those of the first embodiment shown in FIG. 2 will not be explained in duplication.

The present embodiment is characterized in elevating and lowering the fixing bias, when the recording material is conveyed in the fixing nip in the continuous printing operation, according to the number of the recording materials, and also in inverting an electric field formed between the conductive portion of the fixing member and the conductive portion of the pressure member, between a state of a fixing bias value when the recording material is conveyed in the fixing nip and a state of a fixing bias when the fixing member and the pressure member are in a direct contact without a recording material therebetween (corresponding to the embodiment 3).

Figure 10:
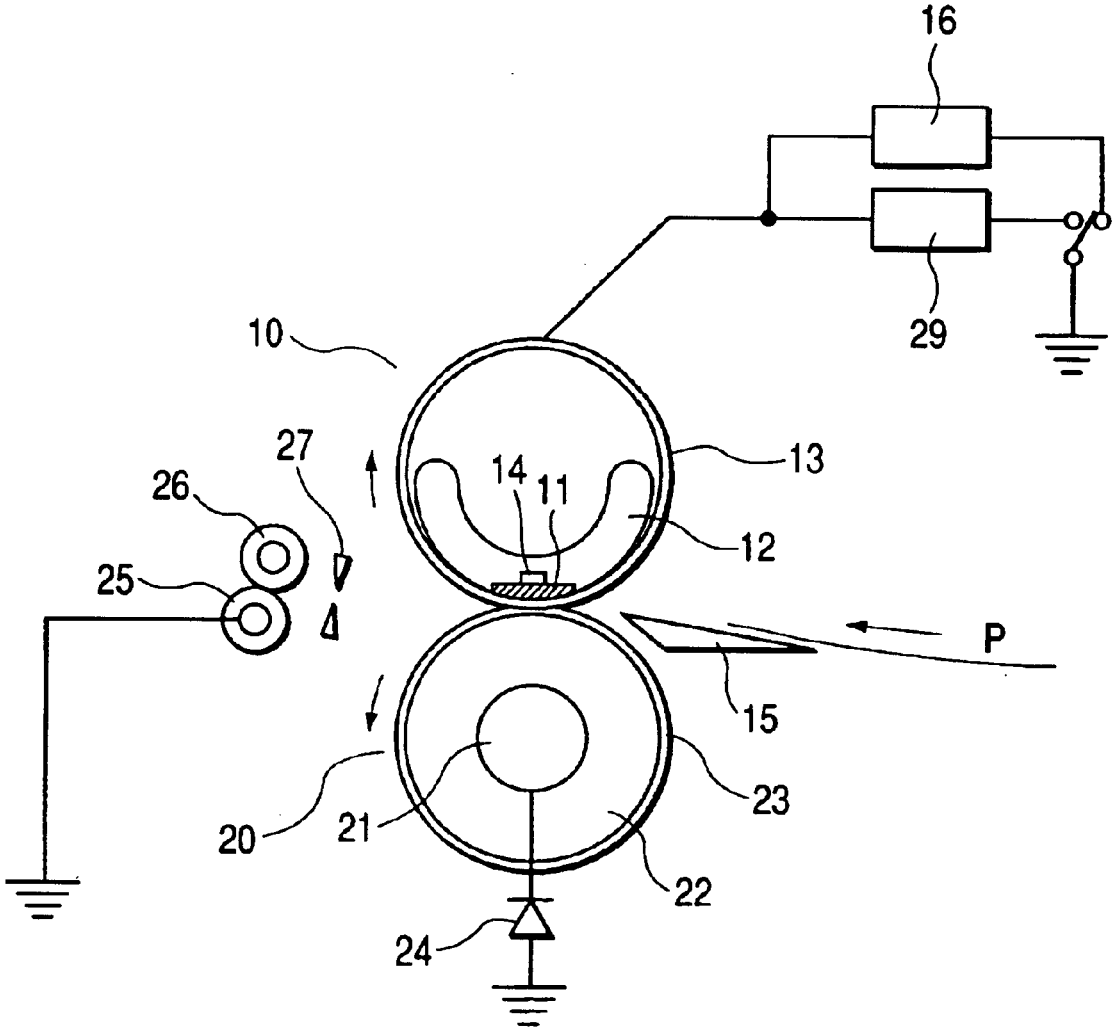
FIG. 10 is a cross-sectional view of a heat fixing apparatus of a third embodiment of the present invention.
Figure 12A:
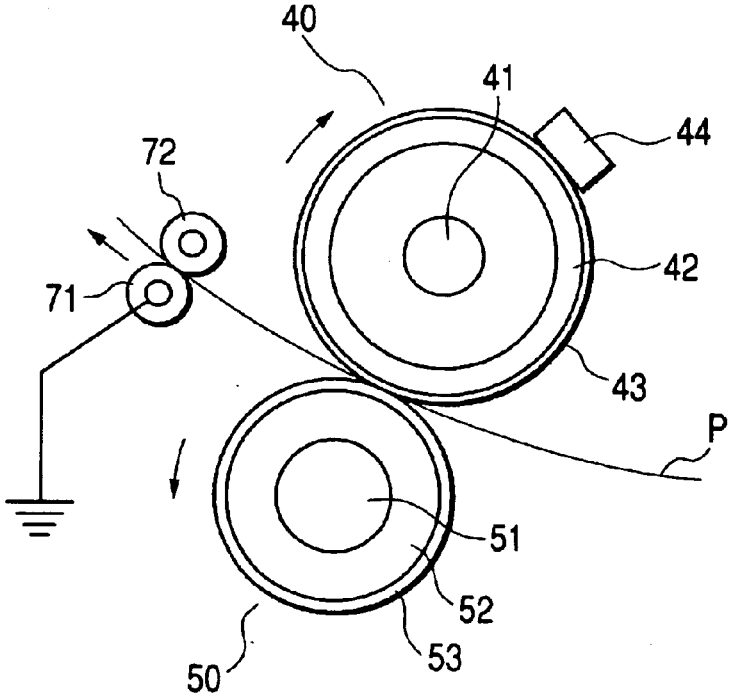
FIGS. 12A and 12B are cross-sectional views of a prior heat fixing apparatus.
Figure 12B:
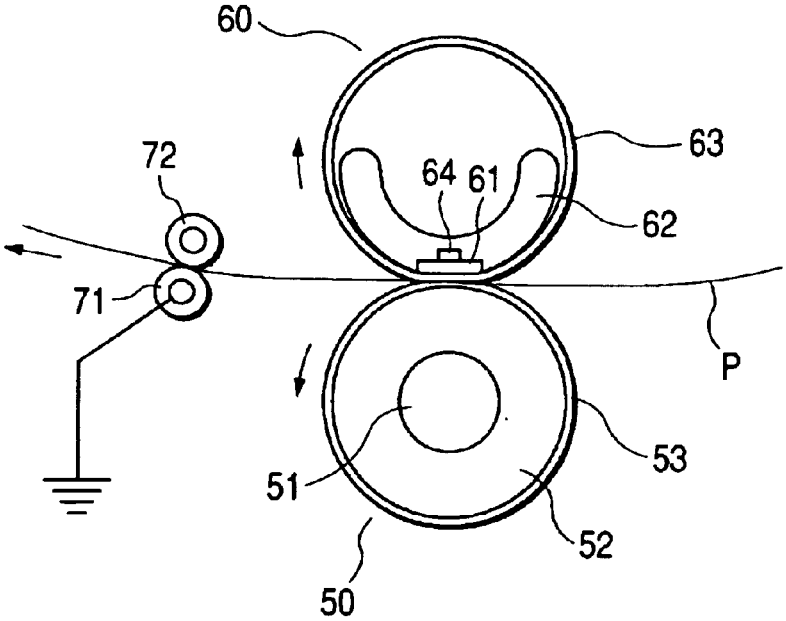
Figure 13A:
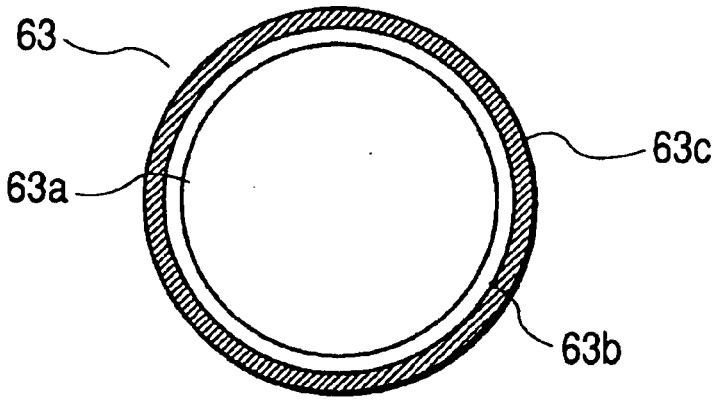
FIGS. 13A and 13B are schematic views showing a cross section of a fixing film and a mechanism of fixed image tailing in a prior configuration.
Figure 13B:
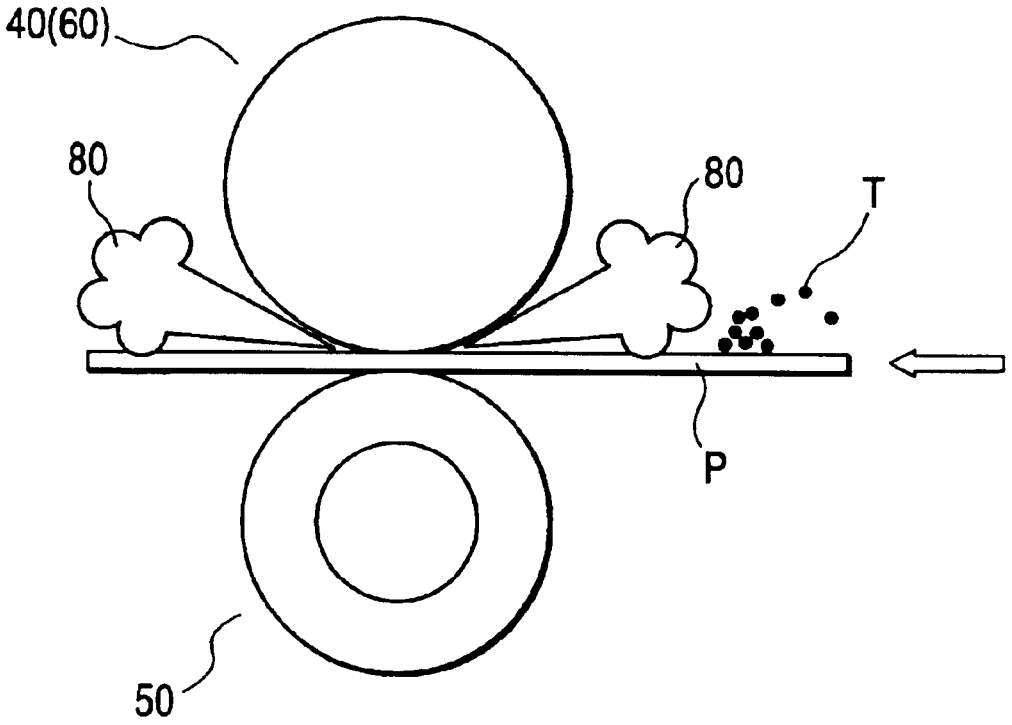

Details of the present embodiment will be explained with reference to FIGS. 10 and 6C. As shown in FIG. 10, there are provided first bias applying means 16 for applying a bias of a polarity same as that of the toner to the conductive primer layer of the fixing film 13, and second bias applying means 29 for applying a bias of a polarity opposite to that of the toner, and such bias applying means are switched at a predetermined timing to apply a bias of either polarity to the conductive primer layer of the fixing film 13.

Figure 6C:
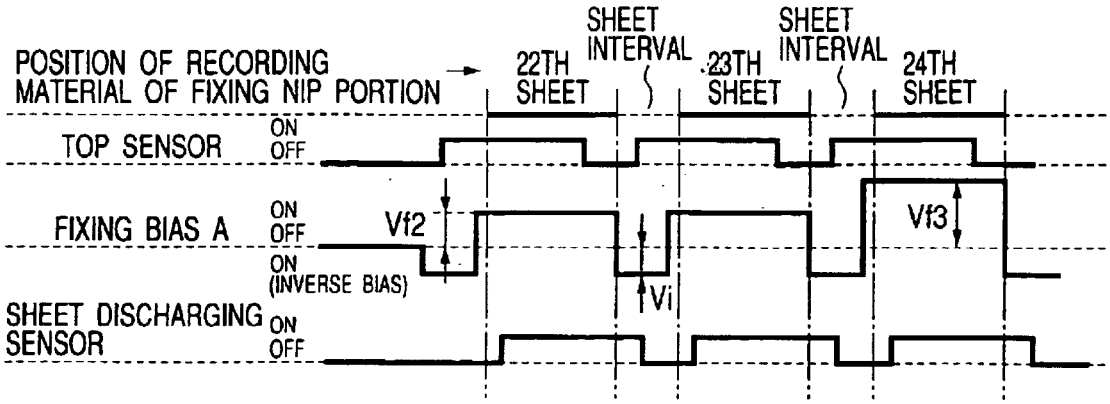

FIG. 6C shows a timing chart of bias application in the present embodiment. FIG. 6C shows a situation in a continuous printing operation, where 22nd to 24th recording materials are conveyed to the fixing nip portion. As shown in FIG. 6C, a fixing bias Vf2 or Vf3 of a polarity same as that of the toner is applied by the first bias applying means 16 after the lapse of a predetermined time from a detection of a leading end of the recording material by the top sensor 8, and the first bias applying means 16 continues to apply the fixing bias at least while the recording material is being conveyed in the fixing nip.

Also at a timing of discharge of the recording material P from the fixing nip, more specifically after the lapse of a predetermined time from a detection of a trailing end of the recording material by the top sensor 8, the bias application by the first bias applying means 16 is turned off and a fixing bias Vi of a polarity opposite to that of the toner is applied by the second bias applying means 29.

The foregoing procedure is repeated, whereby, while the recording material is conveyed in the fixing nip in the continuous printing operation, a fixing bias of a polarity same as that of the toner is applied by the first bias applying means 16 to the conductive primer layer of the fixing film 13, and, when the surface of the fixing film 13 and the surface of the pressure roller 20 are rotated in a direct contact without the recording material, a fixing bias of a polarity opposite to that of the toner is applied by the second bias applying means 29 to the conductive primer layer of the fixing film.

FIG. 6C shows the fixing biases in the 22nd to 24th sheets, and, at the heat fixation of 1st to 20th recording materials in the continuous printing operation, a fixing bias Vf1 is applied in the same manner as Vf3 in the foregoing first embodiment, and, when the recording material is absent in the fixing nip, the bias applying means for the conductive primer layer 13*b* of the fixing film 13 is switched as shown in FIG. 6C thereby applying a bias of a polarity opposite to that of the toner. For a 21st sheet, a fixing bias Vf2 is applied as in the 22nd sheet. For 25th and subsequent sheets, the bias application for the 21st to 24th sheets is repeated.

In the above-described configuration, the fixing bias-applied to the conductive primer layer 13*b* of the fixing film 13 has a polarity same as that of toner when the recording material is conveyed in the fixing nip, while, when the recording material is not present in the fixing nip in an interval between the recording materials, the fixing bias applied to the conductive primer layer 13*b* of the fixing film 13 has a polarity opposite to that of the toner. Therefore, within the contaminating substances such as toner, paper powder, dusts, fibers and scraped powder from the photosensitive drum, transferred from the recording material and electrostatically deposited on the surface of the fixing film 13 or the pressure roller 20, by the application of the bias during the interval of the recording materials of a polarity opposite to that during the heat fixation, those deposited on the surface of the fixing film are rendered more easily movable to the surface of the pressure roller 20 and those deposited on the surface of the pressure roller 20 are rendered more easily movable to the surface of the fixing film 13.

When an next recording material is conveyed to the fixing nip portion, the fixing bias is applied in an inverted state from the bias in the internal of the recording materials, whereby the contaminating substances that have moved from the surface of the fixing film 13 to the surface of the pressure roller 20 during the interval of the recording materials tend to return to the fixing film 13 under the influence of the electric field.

On the other hand, the contaminating substances that have moved from the surface of the pressure roller 20 to the surface of the fixing film 13 during the interval of the recording materials are likewise subjected to an electric field toward the pressure roller 20. Since a recording material P is present between the fixing film 13 and the pressure roller 20 in this state, the contaminating substances are discharged from the fixing nip in a state deposited on the recording material.

In this manner the contaminating substances are less likely accumulated electrostatically on the surface of the fixing film 13 or the pressure roller 20 whereby image defects such as blobs can be prevented. Also in the present embodiment, since the contaminating substances are positively discharged by the succeeding recording material, it is possible to increase an upper limit of the fixing bias when the recording material is conveyed in the fixing nip, thereby further enhancing the effect of the fixing bias against the fixed image tailing.

In order to confirm the effect of the present embodiment against the toner contamination and the fixed image tailing, a confirmation was conducted by varying the fixing bias as shown in a following table. A configuration of the heat fixing apparatus employed in the confirmation was same as that in the first embodiment and will not therefore be explained further. In a table shown in FIG. 11A, Vf indicates a fixing bias when the recording material is present in the fixing nip, and vi indicates a fixing bias in an interval of the recording materials where the recording material is not present in the fixing nip.

FIG. 11B shows a number of jobs until the start of toner contamination and a result of evaluation of the fixed image tailing at different number of sheets, in which a continuous printing of 500 sheets under the fixed bias setting shown in FIG. 11A is taken as a job.

According to these results, by applying a fixing bias of a polarity opposite to that of the toner to the fixing film 13 when the recording material is not present in the fixing nip, it was identified possible to delay the start of toner contamination on the surface of the fixing film 13 or the pressure roller 20, and not to aggravate the toner contamination even when the fixing bias was elevated during the heat fixation of the recording material thereby further alleviating the fixed image tailing.

By generating, particularly in an interval between the recording materials, an electric field between the conductive primer layer 13*b* of the fixing film 13 and the conductive elastic layer of the pressure roller 20 in a direction opposite to the electric field during the heat fixation and by increasing the intensity of such electric field, it is possible to increase an ability for eliminating the contaminating substances deposited on the surface of the fixing film or the pressure roller, thereby maintaining the releasing property of such surface.

The present embodiment has been explained by a system of applying a fixing bias to the conductive primer layer 13*b* of the fixing film 13, but a similar effect can also be obtained by employing a system of applying a bias of a polarity opposite to that of the toner to the conductive member positioned at the downstream side of the fixing nip and coming into contact with the conductive elastic layer of the pressure roller 20 at the heat fixation of the recording material and applying a bias of a polarity same as that of the toner when the recording material is not present in the fixing nip, or by combining the system of the foregoing second embodiment in which a bias is applied to the conductive portion of the fixing member, the pressure roller and the conductive member positioned at the downstream side of the fixing nip.

As explained in the foregoing, in a continuous heat fixing operation of recording materials, the present invention forms, during an early stage of such continuous operation when a fixed image tailing is easily generated, a current path between a fixing member and a conductive member positioned at the downstream side of the fixing nip through a recording material whereby an electric field generated by a voltage drop between the conductive portion of the fixing member and the recording material increases a binding force of an unfixed toner image on the recording material, thereby preventing generation of the fixed image tailing phenomenon.

Also in a latter stage of the continuous operation, the fixing bias is made to increase or decrease, or the direction of an electric field generated by the fixing bias between the fixing member and the pressure member is inverted with respect to the direction of the electric field at the heat fixation of the recording material so as to suppress the current in the above-mentioned current path, thereby preventing a charge injection by an excessive current to the toner immediately after the fixing nip and thus preventing an offsetting of the toner assuming an inverted polarity, leading to a toner contamination on the fixing member or the pressure member.

Also an electrostatic adhesion force is decreased for the contaminating substances such as toner, paper powder, dusts, fibers, scraped powder of the photosensitive drum etc. deposited on the surface of the fixing member or the pressure member, so as to maintain the releasing property of the surface of the fixing member and the pressure member, thereby preventing contamination of the fixing member and the pressure member by toner etc. and preventing an image defect such as blobs. In this manner, there can be realized a fixing apparatus capable of preventing the fixed image tailing caused by an excessive current, and there can be provided a heat fixing apparatus capable of outputting a high-quality fixed image at a high speed.

What is claimed is:

1. A heat fixing apparatus for fixing an unfixed image formed on a recording material, comprising:

a fixing member;

a pressure member in pressure contact with said fixing member to form a fixing nip through which the recording material bearing the unfixed image is passed;

a conductive member contactable with the recording material and positioned on a downstream side of said fixing nip in a conveying direction of the recording material; and bias applying means which applies a bias voltage to at least one of the fixing member and the conductive member;

wherein, in case image formations on a plurality of recording materials are executed in continuation, the bias applying means elevates and lowers the bias voltage in the course of said image formations executed in continuation.

2. A heat fixing apparatus according to claim 1, wherein the image formations on the recording materials are judged to be executed in continuation in case a situation continues where a supply of a succeeding recording material is started before a trailing end of a preceding recording material passes the fixing nip portion.

3. A heat-fixing apparatus according to claim 1, wherein said bias applying means includes:

first bias applying means for applying a bias of a polarity same as that of a toner to said fixing member; and second bias applying means for applying a bias of a polarity opposite to that of the toner to said conductive member and said pressure member;

wherein, in case of heat fixing the recording materials supplied in continuation in the fixing nip portion, said first bias applying means and said second bias applying means are switched to generate bias voltages elevated and lowered for every fixed or variable number of the recording materials.

4. A heat-fixing apparatus according to claim 1, wherein, in case said fixing member and said pressure member are in a direct contact without the recording material, in an interval between said preceding recording material and said succeeding recording material, a direction of an electric field between said fixing member and said pressure member is inverted from a direction of the electric field in a state in which the recording material is present in the fixing nip portion.

5. A heat-fixing apparatus according to claim 1, wherein a rectifying element is connected to a conductive portion of said pressure member, and, at a heat fixation of the recording material, the conductive portion of said pressure member is maintained at a polarity opposite to that of the toner.

6. An image forming apparatus for executing an image formation by conveying a recording material to an image forming unit and conveying the recording material to a heat fixing apparatus thereby fixing an unfixed image to the recording material, wherein the heat fixing apparatus includes:

a fixing member;

a pressure member in pressure contact with said fixing member to form a fixing nip through which the recording material bearing the unfixed image is passed;

a conductive member contactable with the recording material and positioned in a downstream side of said fixing nip in a conveying direction of the recording material; and bias applying means which applies a bias voltage to at least one of the fixing member and the conductive member;

wherein, in case image formations on a plurality of recording materials are executed in continuation, the bias applying means elevates and lowers the bias voltage in the course of said image formations executed in continuation.

7. An image forming apparatus according to claim 6, wherein the image formations on the recording materials are judged to be executed in continuation in case a situation continues where a supply of a succeeding recording material is started before a trailing end of a preceding recording material passes the fixing nip portion.

8. An image forming apparatus according to claim 6, wherein said bias applying means includes:

first bias applying means for applying a bias of a polarity same as that of a toner to said fixing member; and second bias applying means for applying a bias of a polarity opposite to that of the toner to said conductive member and said pressure member;

wherein, in case of heat fixing the recording materials supplied in continuation in the fixing nip portion, said first bias applying means and said second bias applying means are switched to generate bias voltages elevated and lowered for every fixed or variable number of the recording materials.

9. An image forming apparatus according to claim 6, wherein, in case said fixing member and said pressure member are in a direct contact without the recording material, in an interval between said preceding recording material and said succeeding recording material, a direction of an electric field between said fixing member and said pressure member is inverted from a direction of the electric field in a state in which the recording material is present in the fixing nip portion.

10. An image forming apparatus according to claim 6, wherein a rectifying element is connected to a conductive portion of said pressure member, and, at a heat fixation of the recording material, the conductive portion of said pressure member is maintained at a polarity opposite to that of the toner.

11. A heat fixing apparatus for fixing an unfixed image formed on a recording material, comprising:

a fixing member;

a pressure member in pressed contact with said fixing member to form a fixing nip through which the recording material bearing the infixed image is passed;

a conductive member coming into contact with the recording material and positioned ion a downstream side of said fixing nip in a conveying direction of the recording material; and a bias applying circuit which applies a bias voltage to at least either of the fixing member and the conductive member;

wherein, in a case where image formations on a plurality of recording materials are executed in continuation, the bias applying circuit elevates and lowers the bias voltage in the course of said image formations executed in continuation.

12. A heat fixing apparatus according to claim 11, wherein the image formations on the recording materials are judged to be executed in continuation in case a situation continues where a supply of a succeeding recording material is started before a trailing end of a preceding recording material passes the fixing nip portion.

13. A heat-fixing apparatus according to claim 11, wherein said bias applying circuit includes:

a first bias applying circuit for applying a bias of a same polarity as that of a toner to said fixing member; and a second bias applying circuit for applying a bias of a polarity opposite to that of the toner to said conductive member and said pressure member;

wherein, in case of heat fixing the recording materials supplied in continuation in the fixing nip portion, said first bias applying circuit and said second bias applying circuit are switched to generate bias voltages elevated and lowered for every fixed or variable number of the recording materials.

14. A heat-fixing apparatus according to claim 11, wherein, in a case where said fixing member and said pressure member are in a direct contact without the recording material, in an interval between said preceding recording material and said succeeding recording material, a direction of an electric field between said fixing member and said pressure member is inverted from a direction of the electric field in a state in which the recording material is present in the fixing nip portion.

15. A heat-fixing apparatus according to claim 11, wherein a rectifying element is connected to a conductive portion of said pressure member, and, at a heat fixation of the recording material, the conductive portion of said pressure member is maintained at a polarity opposite to that of the toner.

16. An image forming apparatus for executing an image formation by conveying a recording material to an image forming unit and conveying said recording material to a heat fixing apparatus thereby fixing an unfixed image to the recording material, wherein the heat fixing apparatus includes:

a fixing member;

a pressure member in pressure contact with said fixing member to form a fixing nip through which the recording material bearing the unfixed image is passed;

a conductive member coming into contact with the recording material and positioned in a downstream side of said fixing nip in a conveying direction of the recording material; and a bias applying circuit which applies a bias voltage to at least either of the fixing member and the conductive member;

wherein, in a case where image formations on a plurality of recording materials are executed in continuation, the bias applying circuits elevates and lowers the bias voltage in the course of said image formations executed in continuation.

17. An image forming apparatus according to claim 16, wherein the image formations on the recording materials are judged to be executed in continuation in case a situation continues where a supply of a succeeding recording material is started before a trailing end of a preceding recording material passes the fixing nip portion.

18. An image forming apparatus according to claim 16, wherein said bias applying circuit includes:

a first bias applying circuit for applying a bias of a same polarity as that of a toner to said fixing member; and a second bias applying circuit for applying a bias of a polarity opposite to the that of the toner to said conductive member and said pressure member;

wherein, in a case of heat fixing the recording materials supplied in continuation in the fixing nip portion, said first bias applying circuit and said second bias applying circuit are switched to generate bias voltages elevated and lowered for every fixed or variable number of the recording materials.

19. An image forming apparatus according to claim 16, wherein, in a case where said fixing member and said pressure member are in a direct contact without the recording material, in an interval between said preceding recording material and said succeeding recording material, a direction of an electric field between said fixing member and said pressure member is inverted from a direction of the electric field in a state in which the recording material is present in the fixing nip portion.

20. An image forming apparatus according to claim 16, wherein a rectifying element is connected to a conductive portion of said pressure member, and, at heat fixation of the recording material, the conductive portion of said pressure member is maintained at a polarity opposite to that of the toner.

* * * * *

UNITED STATES PATENT AND TRADEMARK OFFICE

CERTIFICATE OF CORRECTION

PATENT NO. : 6,920,293 B2
DATED : July 19, 2005
INVENTOR(S) : Satoru Izawa et al.

It is certified that error appears in the above-identified patent and that said Letters Patent is hereby corrected as shown below:

Title page,
Item [56], References Cited, FOREIGN PATENT DOCUMENTS,
"2001075417 A" should read -- 2001-75417 A --; and
"2002108125 A" should read -- 2002-108125 A --.

Column 4,
Line 40, "dusts," should read -- dust, --.

Column 7,
Line 39, "is-contacted" should read -- is contacted --.

Column 9,
Line 47, "an" should read -- a --.

Column 12,
Line 58, "dusts," should read -- dust, --.

Column 14,
Line 8, "was" should read -- were --.

Column 18,
Line 11, "fist" should read -- first --.
Line 26, "dusts," should read -- dust, --.

Column 22,
Line 56, "voltages" should read -- voltage --.

Column 23,
Line 12, "infixed" should read -- unfixed --.

UNITED STATES PATENT AND TRADEMARK OFFICE

CERTIFICATE OF CORRECTION

PATENT NO. : 6,920,293 B2
DATED : July 19, 2005
INVENTOR(S) : Satoru Izawa et al.

It is certified that error appears in the above-identified patent and that said Letters Patent is hereby corrected as shown below:

Column 24,
Line 20, "circuits" should read -- circuit --.

Signed and Sealed this

Eighth Day of November, 2005

JON W. DUDAS
*Director of the United States Patent and Trademark Office*